US009443492B2

(12) United States Patent
Zenker

(10) Patent No.: US 9,443,492 B2
(45) Date of Patent: Sep. 13, 2016

(54) DISPLAY WITH NON-HOMOGENOUS SPECTRAL TRANSMISSION CURVE

(75) Inventor: Thomas Zenker, Nieder-Olm (DE)

(73) Assignee: SCHOTT AG, Mainz (DE)

( * ) Notice: Subject to any disclaimer, the term of this patent is extended or adjusted under 35 U.S.C. 154(b) by 0 days.

(21) Appl. No.: 13/824,893

(22) PCT Filed: Dec. 2, 2011

(86) PCT No.: PCT/EP2011/071627

§ 371 (c)(1),
(2), (4) Date: Jun. 12, 2013

(87) PCT Pub. No.: WO2012/076412

PCT Pub. Date: Jun. 14, 2012

(65) Prior Publication Data

US 2013/0328946 A1 Dec. 12, 2013

(30) Foreign Application Priority Data

Dec. 8, 2010 (DE) ..... 10 2010 061 123
Dec. 8, 2010 (DE) ..... 20 2010 013 087 U
Jun. 6, 2011 (DE) ..... 10 2011 050 878

(51) Int. Cl.

| | |
|---|---|
| ***G09G 5/10*** | (2006.01) |
| ***H05B 6/12*** | (2006.01) |
| ***G09F 9/35*** | (2006.01) |
| ***G09F 13/22*** | (2006.01) |
| ***G09F 23/00*** | (2006.01) |

(52) U.S. Cl.

CPC *G09G 5/10* (2013.01); *G09F 9/35* (2013.01); *G09F 13/22* (2013.01); *G09F 23/00* (2013.01); *H05B 6/1218* (2013.01)

(58) Field of Classification Search

CPC ..... H05B 6/1218; B60K 2350/203
See application file for complete search history.

(56) References Cited

U.S. PATENT DOCUMENTS 7,123,228 B2 10/2006 Ozaki et al.
7,486,304 B2 2/2009 Bergquist et al.

(Continued)

FOREIGN PATENT DOCUMENTS

CA 2680501 A1 11/2005
DE 1631700 U 11/1951

(Continued)

OTHER PUBLICATIONS

English Translation of International Search Report dated Apr. 4, 2012 from International Application No. PCT/EP2011/071627, 3 pages.

(Continued)

*Primary Examiner* — Quan-Zhen Wang
*Assistant Examiner* — Xuemei Zheng
(74) *Attorney, Agent, or Firm* — Ohlandt, Greeley, Ruggiero & Perle, LLP

(57) ABSTRACT

A display having a substrate is provided. The substrate is at least partially made of a partially transparent material having a non-homogenous spectral transmission curve. The substrate has a display face and a rear face with at least one luminous element disposed in the region of the rear face. The luminous element includes at least two base color lamps, where the base color brightness of at least one of the base color lamps is different, in order to compensate for the spectrally non-homogenous transmission curve of the substrate.

30 Claims, 6 Drawing Sheets

(56) References Cited

U.S. PATENT DOCUMENTS

| | | | | |
|---|---|---|---|---|
| 7,506,996 | B2 * | 3/2009 | Birman et al. | 362/236 |
| 8,624,823 | B2 * | 1/2014 | Park et al. | 345/102 |
| 2002/0159002 | A1 | 10/2002 | Chang | |
| 2005/0116921 | A1 | 6/2005 | Kim | |
| 2005/0225575 | A1 * | 10/2005 | Brown Elliott et al. | 345/694 |
| 2006/0081773 | A1 | 4/2006 | Rains, Jr. et al. | |
| 2006/0258028 | A1 | 11/2006 | Hong | |
| 2007/0045524 | A1 * | 3/2007 | Rains, Jr. | F21K 9/00 250/228 |
| 2007/0108184 | A1 | 5/2007 | Imamoto et al. | |
| 2007/0132706 | A1 | 6/2007 | Nishimura et al. | |
| 2007/0285378 | A1 * | 12/2007 | Lankhorst et al. | 345/102 |
| 2008/0099449 | A1 * | 5/2008 | England et al. | 219/121.48 |
| 2008/0207424 | A1 * | 8/2008 | Aitken et al. | 501/10 |
| 2008/0211973 | A1 | 9/2008 | Hekstra et al. | |
| 2009/0072263 | A1 | 3/2009 | Paolini et al. | |
| 2010/0013872 | A1 | 1/2010 | Masuda et al. | |
| 2010/0061078 | A1 | 3/2010 | Kim | |
| 2011/0011851 | A1 * | 1/2011 | Kataoka et al. | 219/622 |

FOREIGN PATENT DOCUMENTS

| | | | |
|---|---|---|---|
| DE | 10 2004034761 | A1 | 2/2006 |
| DE | 10 2008050263 | A1 | 4/2010 |
| DE | 10 2009013127 | A1 | 9/2010 |
| DE | 102009010952 | A1 | 9/2010 |
| DE | 20 2010013087 | U1 | 3/2011 |
| DE | 10 2010061123 | A1 | 6/2012 |
| DE | 10 2011050878 | A1 | 6/2012 |
| EP | 0699937 | A2 | 3/1996 |
| EP | 2068192 | A1 | 6/2009 |
| FR | 2955400 | A1 | 7/2011 |
| JP | 2007031196 | A | 2/2007 |
| JP | 2007039303 | A | 2/2007 |
| JP | 2010024278 | A | 2/2010 |
| WO | 2008029324 | A2 | 3/2008 |

OTHER PUBLICATIONS

English Translation of International Preliminary Report on Patentability dated Jun. 12, 2013 corresponding to International Patent Application No. PCT/EP2011/071627.

English Translation of Written Opinion dated Jun. 8, 2013 corresponding to International Patent Application No. PCT/EP2011/071627.

* cited by examiner

| White regions W1, W2 | | |
|---|---|---|
| | x | y |
| W1 | 0,3 | 0,25 |
| | 0,26 | 0,33 |
| | 0,37 | 0,43 |
| | 0,51 | 0,48 |
| | 0,48 | 0,35 |
| | 0,35 | 0,3 |
| | 0,3 | 0,25 |
| | | |
| W2 | 0,3068 | 0,3113 |
| | 0,3028 | 0,3304 |
| | 0,3205 | 0,3481 |
| | 0,3207 | 0,3462 |
| | 0,3376 | 0,3616 |
| | 0,3551 | 0,376 |
| | 0,3548 | 0,3736 |
| | 0,3736 | 0,3874 |
| | 0,4006 | 0,4044 |
| | 0,3996 | 0,4015 |
| | 0,4299 | 0,4165 |
| | 0,4562 | 0,426 |
| | 0,4813 | 0,4319 |
| | 0,4593 | 0,3944 |
| | 0,4147 | 0,3814 |
| | 0,3889 | 0,369 |
| | 0,3898 | 0,3716 |
| | 0,367 | 0,3578 |
| | 0,3512 | 0,3465 |
| | 0,3515 | 0,3487 |
| | 0,3366 | 0,3389 |
| | 0,3222 | 0,3243 |
| | 0,3221 | 0,3261 |
| | 0,3068 | 0,3113 |

Fig. 3

DISPLAY WITH NON-HOMOGENOUS SPECTRAL TRANSMISSION CURVE

The invention relates to a display with a substrate, at least partially composed of a partially transparent material, having a non-homogenous spectral transmission curve, the substrate having a display face and a rear face, whereby at least one luminous element that is controlled by a control unit is disposed in the region of the rear face.

Different possibilities for the backlighting of transparent or partially transparent substrates are known from the prior art. For example, glass materials made of a glass or glass-ceramic material have found use as substrates.

In particular, glass-ceramic cooktops that are made of single-color glass ceramics are known. This coloring is necessary in order to prevent a view onto the technical components such as heating elements and conductors disposed on the rear face. Now, in order to obtain luminous effects on the front face of the glass ceramics, luminous elements are installed on the rear face, which shine through the glass ceramics. Based on the non-homogeneous transmission curve of the substrate material, when light of mixed colors or non-monochromatic luminous elements passes through the glass ceramics, a shift in color occurs, so that the color location or color coordinates of the light emitted from the luminous element differs from the display on the display face. For substrate materials with predominantly red transmission, such as the known, commercially available glass-ceramic cooktops, preferably red displays can be implemented. The limited selection of single-color LED displays and the limited transmission curve of the known glass ceramics very greatly limits the color spectrum available for user information. These displays are by default limited only to red or partly also to orange, yellow and green, which also results from the single coloring of the glass-ceramic cooktop.

In DE 10 2008 050 263, the transmission curve is described for a glass-ceramic cooktop, which also permits, in particular, a transmittance for blue light at approximately 450 nm and thus an expanded color display capability.

In DE 10 2009 013 127 A1, different display possibilities are demonstrated based on these glass ceramics. By broadening the transmission spectrum also to the blue wavelength region, in fact, the coloring of displays has been expanded. Based on the small number of single-color, nearly monochromatic LED displays, however, the number of colors visible to the user is also greatly limited in the case of these glass-ceramic cooktops. A white LED, for example, would be perceived by the user as having a clearly yellowish tinge due to the transmission curve of the cooktop. The color coordinates of a mixed color made of a combination of at least two colored LEDs are also shifted on the display face. The color coordinates of luminous elements are not shifted only when they involve individual, nearly monochromatic luminous elements such as single-color LEDs.

If mixed colors of at least two such single-color LEDs or spectrally broadband luminous elements, such as, for example, white LEDs or fluorescent tubes are used, then a shifting of the color coordinates of the luminous element is brought about by a non-homogeneous transmission curve of the substrate material.

Also known are color displays, such as color television cathode ray tubes or a plurality of technical variations of color-LCD displays, which, based on at least 3 base colors, can portray the entire color space in the color polygon among the primary colors used; in the case of red-green-blue (RGB) in the RGB color triangle, of the CIE color space (CIE-Commission internationale de l'éclairage, Standard colorimetric system, sRGB, see IEC 61966-2-1), and particularly also the white point. In general, RGB colors are used as the base colors. There are also applications in which more than 3 base colors are used; for example, cyan, yellow and magenta are additionally used. If colored light-emitting diodes (LEDs) are the light source, then the spectral colors RGB available with LEDs are used as the base colors, for example, with the wavelengths of 470 nm, 520 nm and 630 nm.

In the case of substrates with a relative transmission difference of 50% between 470 nm and 630 nm, noticeable and disturbing shifts of the color coordinates of common, commercially available, white or color displays are seen. In the case of substrates in which the relative transmission differences between 470 nm and 630 nm are approximately 80% or more, it is seen that with common, commercially available color displays, the entire color space, particularly the white point, can no longer be presented. This is particularly true for commercially available color displays, in which the base colors are produced by means of color filters or color phosphors or other luminescent color materials. The latter are conventionally used in an aperture mask in front of a white background illumination or electron beam source or a blue light source or a UV light source, in order to produce the three RGB colors. This is currently the case in all commercial color displays, as they are used in PC displays, TVs, PDAs, CRTs, mobile phones and other applications. Such displays based on color filters are not suitable for representing the total color space on the plane of the display in substrates with such spectrally non-homogeneous transmission for the different spectral colors. The causes for this are filters or luminescent materials that are too broadband, from 100 nm FWHM (full width at half maximum) or more, so that the base colors of the color triangle are shifted in the CIE color space by the non-homogeneous filtering effect of the substrate, so that the white point can no longer be represented on the display face of the substrate, particularly in displays whose original color space is very limited, for example the sRGB color space (IEC 61966-2-1; see FIG. 1). Likewise, commercial white displays that are based on white, broadband fluorescent light, such as fluorescent tubes, white LEDs or even incandescent lights, can hardly be used under such a substrate for producing white color perception on the display plane. In particular, the white point is shifted to a color location in the direction of higher spectral transmission of the CIE polygon.

Color displays are also known, however, that are built without color filters. Their color reproduction is based on a sequential color control. This technique has been known since the development of color televisions. In more recent developments of color LCD displays, this technique has now also found use. More efficient, more intense brightness, as well as larger color spaces can be produced. Technically, this was previously limited by the required rapid switching times of LCD units. The color mixings are produced here directly via the three RGB colors of an RGB backlighting without the detour via broadband color filters. In this way, the RGB colors are sequentially controlled, so that in rapid sequence ($<1/180$ sec), red, green and blue fields are produced, which the eye cannot resolve over time and thus perceives this as a color segment. Both the color point as well as the brightness of the individual image points can be produced, for example, by a different brightness control (gray scale) of the LCD image points during the partial images for the individual colors (for example, U.S. Pat. No. 7,123,228; US 2005 116921; U.S. Pat. No. 7,486,304; US 2008 211973A;

US 2007 285378 A; US 2002 159002A; DE 19631700). Here also, the white point set in the display is shifted by the different transmission of the RGB base colors and thus the color representation is falsified.

In displays through support materials with spectrally non-homogeneous transmission in the region between 380 nm and 780 nm, for example, colored glasses, the total color space can be represented, in principle, even here, in a selected CIE polygon, including white, as long as all selected spectral base colors penetrate the support substrate, at least partially. This is also true for newer types of black glass ceramics, for example, according to DE 10 2008 050 263, or also for those that are produced by single coloring with $Ti^{3+}$ by means of reducing refining (for example, ZnS refining).

The object of the invention is to create a display of the type mentioned initially, with which attractive light effects can be produced within the visible light spectrum in substrates with non-homogeneous transmission curves.

This object is achieved in that the luminous element has at least two, preferably three base-color lamps, and in that the brightness of the base colors of at least one of the base-color lamps is adjusted relative to the setting without substrate, so that the shift of color coordinates due to the non-homogeneous transmission curve of the substrate can be compensated for or can be corrected to the desired color coordinates, in particular a color polygon is spanned in the CIExyY color space, which makes possible the setting of white color coordinates. The compensation and adjustments of the color coordinates are made by a control unit. By the use of separately controllable base-color lamps, in addition, applications are possible, which also make possible single-color displays with any color coordinates, even fluctuating ones, or color displays especially also of the type that require a sequential control of the base colors.

By adjusting the basic brightness of the base-color lamps, the color coordinates on the display face of the substrate can compensate for the original color coordinates of a single-color display as a function of the transmission through the substrate material, in particular, for white color coordinates. In the case of color displays including, the white balance can be correspondingly corrected.

In general, the technique according to the invention can be used for all partially transparent glasses, glass ceramics or other partially transparent substrates that have a spectrally non-homogeneous transmission for the selected base colors, in particular, the RGB base colors. This can be a continuous transmission region with spectrally different transmission values of less than 100%, or also mutually delimited RGB transmission windows of such transmission values, which permit the transmission of an RGB color triplet or other base colors of a color polygon.

In order to elicit sufficiently bright color perceptions in the blue to red spectral region with commercially common light sources (for example, LEDs) through the glass ceramics onto the display face formed by the front side of the glass ceramics, glass ceramics are necessary that have an average transmission of >0.2%, preferably of >0.4%, for each of the spectral regions of 420-500 nm, 500-620 nm and 550-640 nm. On the other hand, the spectral transmission should also not be too great in order to prevent a view into the inner structure of the cooktops without additional aids, such as light-tight underside coatings and to present an esthetically preferred, uniform-color, non-transparent cooking surface. This maximum transmission is presently defined at <40%, preferably <25% at 400 nm to 700 nm, and additionally an average of <4% between 450-600 nm. Such substrates are frequently also called "black glass ceramics", which offer a particularly good optical coverage in order to keep the technical components invisible.

According to a preferred embodiment of the invention, it can be provided that the substrate has a relative transmission difference $d_T$ in the wavelength region between 470 nm and 630 nm of $d_T$>80%, preferably 95%>$d_T$>80%. In such substrates, with the displays according to the invention, white and color displays can be achieved in the selected color space, which could previously not be presented.

A preferred embodiment of the invention is such that the relative transmission of the substrate is in the range between 9% and 15% at a wavelength of 520 nm and between 7% and 13% at a wavelength of 470 nm, relative to the transmission at a wavelength of 630 nm. Such substrates with proportional "blue" transmission are optically attractive and can illuminate the display face in displays, white, in particular.

A possible display is one in which the luminous element comprises three base-color lamps, one of which emits red, one emits green, and one emits blue light corresponding to an RGB triangle of the CIE color space. These base-color lamps can be implemented cost-effectively as standardized components. In addition, these base-color lamps that are designed, for example, as LEDs, are sufficiently narrow-band, so that, for example, a corrected RGB color space and, in particular, the achromatic point E (x=⅓, y=⅓, CIExyY 1931) can be presented by the above-described substrate materials. An embodiment with three LED base-color lamps (4.1) is configured such that one emits light between the dominant wavelengths of 580 nm and 750 nm, a second emits light between 480 nm and 590 nm and a third emits light between 400 nm and 505 nm. Preferably, three LED base-color lights are used, which emit light at the dominant wavelengths of 470 nm, 520 nm and 630 nm with a deviation from the dominant wavelengths of ±5 nm.

Another preferred embodiment of the invention is one is which the luminous element comprises two base-color lamps, and that the line connecting the color coordinates of these base-color lamps intersects or is tangential to the white region $W_1$ in the CIExyY diagram, especially the white region $W_2$, and particularly preferred, intersects the Planck color curve.

Particularly small displays can be realized with such a design of the luminous element.

In this way, it can be particularly provided that the peak wavelength of one of the two base-color lamps is in the region between 420 nm and 510 nm, and particularly preferred, in the region between 468 nm and 483 nm, and/or that the peak wavelength of one of the two base-color lamps is in the region between 550 nm and 670 nm, and particularly preferred, in the region between 570 and 585 nm.

These base-color lamps are particularly suitable for the through-illumination of familiar single-color glass ceramics, whereby in this case, white light phenomena can then be presented on the display face of the substrate. The base-color lamps with a peak wavelength in the preferred region of 468 nm to 483 nm or 570 nm to 585 nm are particularly suitable for familiar cooktop applications.

According to the invention, presenting white color coordinates is not to be limited to the achromatic point E. Instead, the eye tolerates a wide region of color coordinates perceived as white. Among other things, this also depends on the color coordinates of the surrounding surfaces, such as a red-black cooktop surface. According to the invention, for white compensation, the objective is thus to obtain color coordinates that lie within the boundaries of white region W1 with color temperatures between 2000 K and 10,000 K (CCT, color correlated temperature), preferably within the boundaries of the white region W2. The white region W2 in this case encompasses the white fields defined in ANSI (ANSI Binning) 1A, . . . , 1D, . . . , 8D, that are typically referred to by LED manufacturers in order to characterize the color coordinates of their white LEDs. This region corresponds to color temperatures of 2580 K to 7040 K, corresponding to a perceived white from cold to warm white. The corner points of the white regions W1 and W2 defined according to the invention in FIG. 1 are listed in FIG. 3.

A display according to the invention can also be one in which one or more elements are disposed on or in the region of the display face and/or the rear face and these are disposed at least in regions in the display region produced by the luminous element. Symbols, logos, etc. can be backlit with these displays or they can be illumined or illuminated. The symbols, signs and surfaces can be produced in this case by masks that are solidly introduced onto the substrate or are inserted between display unit and substrate or are part of an enclosing housing for the device.

In order to uniformly mix the light of the base colors in the luminous element and thus to obtain a homogeneous display, it may be provided that the luminous element has an optical diffuser element.

In a display according to the invention, it may be provided that a light sensor receives a part of the light emitted on the display face and that, in particular, the spectral composition of the light emitted from the luminous element can be changed by means of a control unit. Shifts in the color point, for example, due to aging and temperature, can be compensated for by means of this measure; but also, preselected, compensated, color points can be adjusted, especially in connection with the spectrally non-homogeneous transparent substrate. In addition, preselected color points can be adjusted over a series of substrates, independently from fluctuations of the spectral transmission curve of individual substrates that are caused by the manufacturing process.

In addition, appropriate laser diodes or laser light sources are considered as narrow-band base-color lamp sources.

Further, it is advantageous to enclose the luminous element in a housing in an at least partially light-tight manner in order to avoid scattered radiation and external light effects.

Thermochromic effects of the substrate can also be presented within the scope of the invention, by means of shifts in the color point, in particular by setting a white point. Thermal shifts of the transmission spectrum of the substrate that occur would cause shifts of the color point of the display away from the white point or to the white point, which the eye can well recognize.

In order to create complex displays, it may be provided that several luminous elements form a segment display and that each luminous element has three base-color lamps, in particular that the luminous elements form a 7-segment display. As already mentioned, displays can be created by means of at least one RGB-LED. In this case, the color point can be selected randomly in the RGB triangle, preferably a white point, so that single-color, preferably white displays can be presented.

Solutions can also be provided for complex displays such as color displays (for example LCDs, TFTs).

Of course, conceivable variants, narrow-band color filters cannot be used in the display while retaining white backlighting. These filters ensure that the spanned color polygon is retained, i.e. the color coordinates of the base colors are not shifted, but the differences in brightness of the base colors, which are caused by the substrate, are not compensated for. This leads to color shifts of the color display.

In contrast, a shift of color coordinates of the backlighting of a display with color filters is another variant according to the invention. The backlighting is provided via at least one RGB luminous element. Here, the color coordinates of the backlighting are adjusted so that the shift in color coordinates after passing through the substrate is compensated for. This allows both the white point of the display as well as its base colors to be almost at the original color coordinates, as in the case of a neutral, spectrally uniformly transmitting substrate. Small, but negligible aberrations occur here due to non-linear effects among the two filters, the substrate and the base-color filters. The non-linear effects occur due to the multiplication of the two filter transmission spectra under the wavelength integral in the X, Y, Z functions of the CIExyY formalism.

In addition, in particular, color displays can be realized without color filters, whose backlighting is provided in pixels via at least one sequentially controlled luminous element. The white balance shifted by the substrate is compensated for by correcting the basic brightness of the base-color lamps. The sequential control of the base colors and the individual luminous element then permits a color presentation and gray-scale regulation, as can be presented in the sequential display. Non-linear effects as in the case of a display based on color filters and corrected color coordinates of the backlighting do not occur here. In particular, intensity losses due to the filters are avoided.

Accordingly, two solutions according to the invention for the use of color displays are provided by composite substrates according to the invention. On the one hand, in displays with color filters, a color correction of the background illumination is applied; on the other hand, in displays without color filters, the partial color images are sequentially controlled in the known way, the base-color intensities of the pixel-type RGB lights needing to be corrected, so that the white point of the display is corrected (white balance).

The invention will be explained in further detail in the following on the basis of examples of embodiment shown in the drawings. Herein:

FIG. 3 shows the coordination of the white regions indicated in FIGS. 1 and 2;

Figure 1:
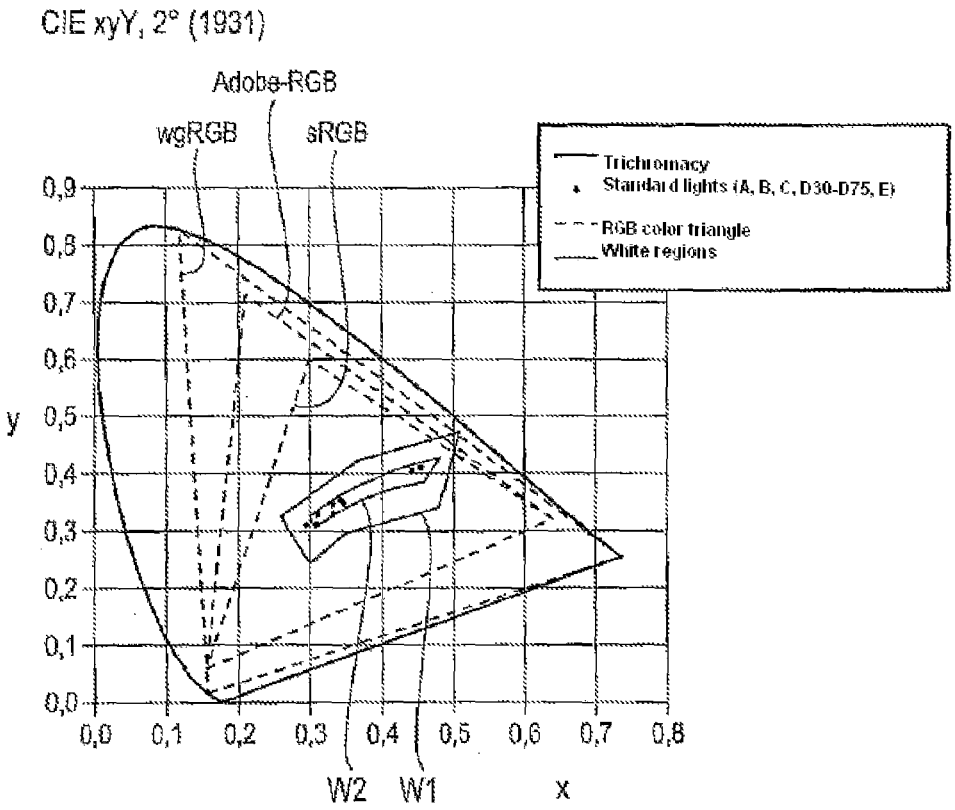
FIG. 1 shows by way of example a CIE/1931 diagram with standardized sRGB, Adobe RGB, wg-RGB color spaces, standard white points and defined white regions W1 and W2.
Figure 2:
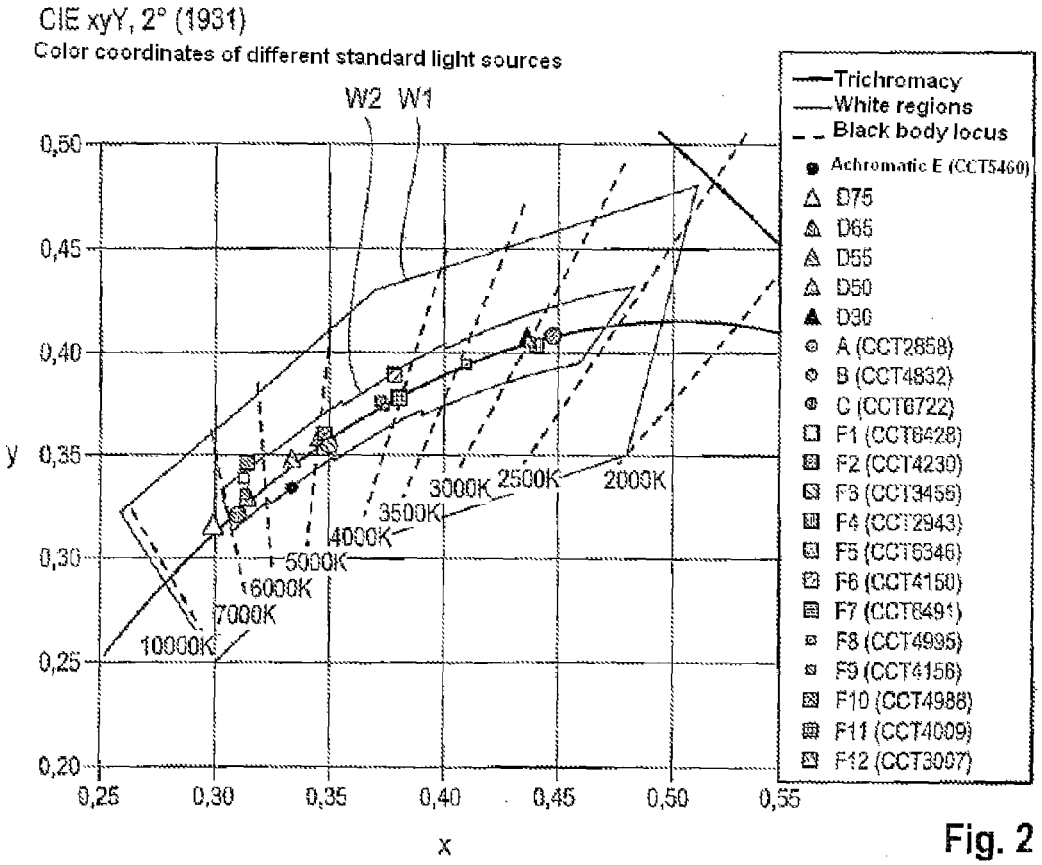
FIG. 2 shows an enlarged detail presentation of the diagram according to FIG. 1.
Figure 4:
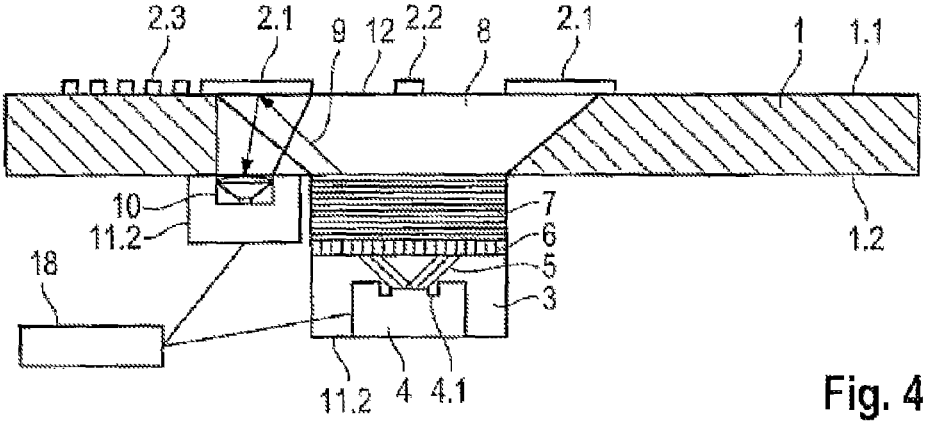
FIG. 4 shows in schematic representation and in lateral view a glass-ceramic cooktop with a display.

FIG. 4 shows a cooktop having a substrate 1, composed of glass-ceramic material with a transmission between 0.1% and 40% (preferably 25%) in the spectral region between 400 nm and 700 nm. The glass ceramics are of one color and partially transparent. Therefore, the transmission is non-homogeneous in the spectral region. In the present example of embodiment, the transmission behavior is selected so that the three base colors of red, green, blue of the RGB triangle according to the CIE color space (CIE-Cornmission International de l'éclairage, Standard colorimetric system (see FIGS. 1 and 2)) are transmitted through the substrate with different transparency. For such colored, partially transparent substrates 1, in particular for those in which the transmission values are between 0.1% and 40% (preferably 25%) in the spectral region between 400 nm and 700 nm and which have relative transmission differences $d_T$ in the wavelength region between 470 nm and 630 nm of $d_T$>50%, preferably $d_T$>80%, preferably 95%>$d_T$>80%, the display will be white and, in the color space of the corresponding CIE polygon, color displays will be provided, particularly decorative lighting/displays. Substrate 1 has an upper display face 1.1 facing the observer and a lower rear face 1.2. Heating elements, electrical conductors, fastenings, etc. (not shown in FIG. 1) of the cooktop are disposed in the region of the rear face 1.2. As a consequence of sealing off the view through substrate 1, the view onto these components is blocked. The display face 1.1 forms the viewing and functional surfaces, on which cooking vessels can be placed. Decorative elements 2.1 to 2.3 are coated on the display face 1.1 and rigidly joined to substrate 1. Decorative elements 2.1 to 2.3 are formed, for example, from ceramic colors baked into the substrate 1. As known from the prior art, decorative elements 2.3 form markings of cooking zones. Decorative elements 2.1 and 2.2 form a decoration, which is illuminated by the display. One of the decorative elements 2.1 (at the left in FIG. 2) simultaneously forms a reflecting element.

In the region of the rear face 1.2 is disposed a luminous element 4, which is formed by an RGB-LED. This luminous element 4 has one red, one green and one blue light-emitting LED as base-color lamps 4.1. During operation, the luminous element 4 emits a light cone 5, which is guided through a diffuser 6. The light of the RGB-LEDs in the emerging light field 7 is intermixed uniformly and homogeneously by this diffuser 6, so that after diffuser 6, a homogeneous perceived color is formed on substrate 1. In order to prevent a change in the composition of the light field 7, a light-tight enclosing housing 11.2 is used, which shields the luminous element 4, the diffuser 6 and the entire light path under the substrate 1 from the environment. The mixed light of the light field 7 in the form of a light cone 8 is guided through the substrate 1 and is emitted on the display face 1.1. In this way, the decorative element 2.2 is illuminated. The decorative elements 2.1, for example, form a frame that is illuminated.

The ("total") light emitted by the luminous element 4 relative to the RGB composition is constituted such that the non-uniform transmission of the substrate 1 is compensated for by fine-tuning the brightness of the base colors of the individual base-color lamps 4.1. Accordingly, the desired perceived color is formed on the display face. In particular, an optically pleasing white light presentation can be produced.

At the left decorative element 2.1, the light of the light cone 8 is reflected on the display face 1.1 and conducted through the substrate 1 again to the rear face 1.2. A light sensor 10 is disposed there. The light sensor 10 is accommodated in a light-tight enclosing housing 11.1.

The light sensor 10 receives part of the light of the emitted base colors (RGB) after passage through the substrate 1. Shifts in the color point caused by aging and/or temperature can be compensated for by means of a control unit 18, as it is used, for example, in the display according to FIG. 4.

Figure 5:
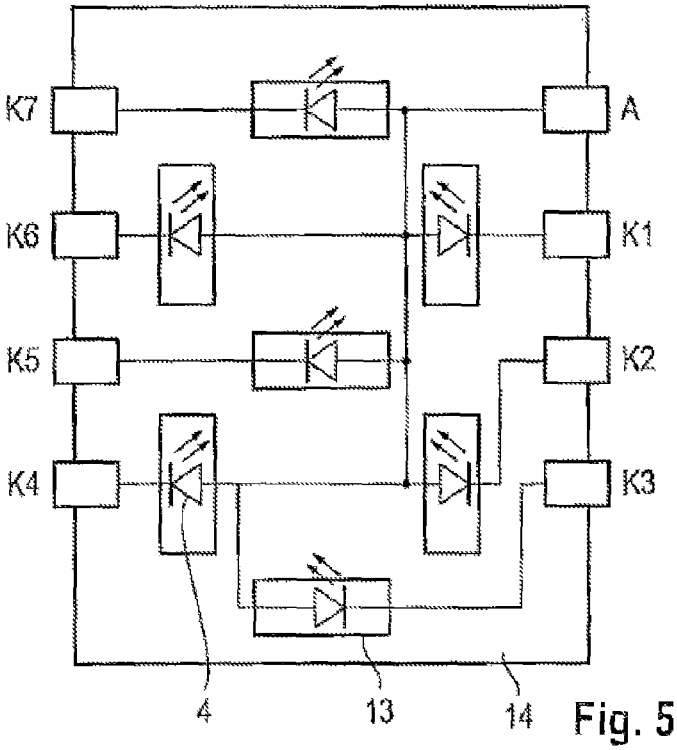
FIG. 5 shows a common commercial 7-segment display in schematic representation.

FIG. 5 shows a common commercial 7-segment display 14, in which seven LEDs, preferably of the same structure, are now incorporated as luminous elements 4. The luminous elements 4 each form a light segment 13 and are grouped in the form of a FIG. 8, as is common in 7-segment displays. A simple wiring structure is achieved in that all luminous elements 4 are connected to a common anode A and each one is connected to its own cathode $K_1$ to $K_7$.

Figure 6:
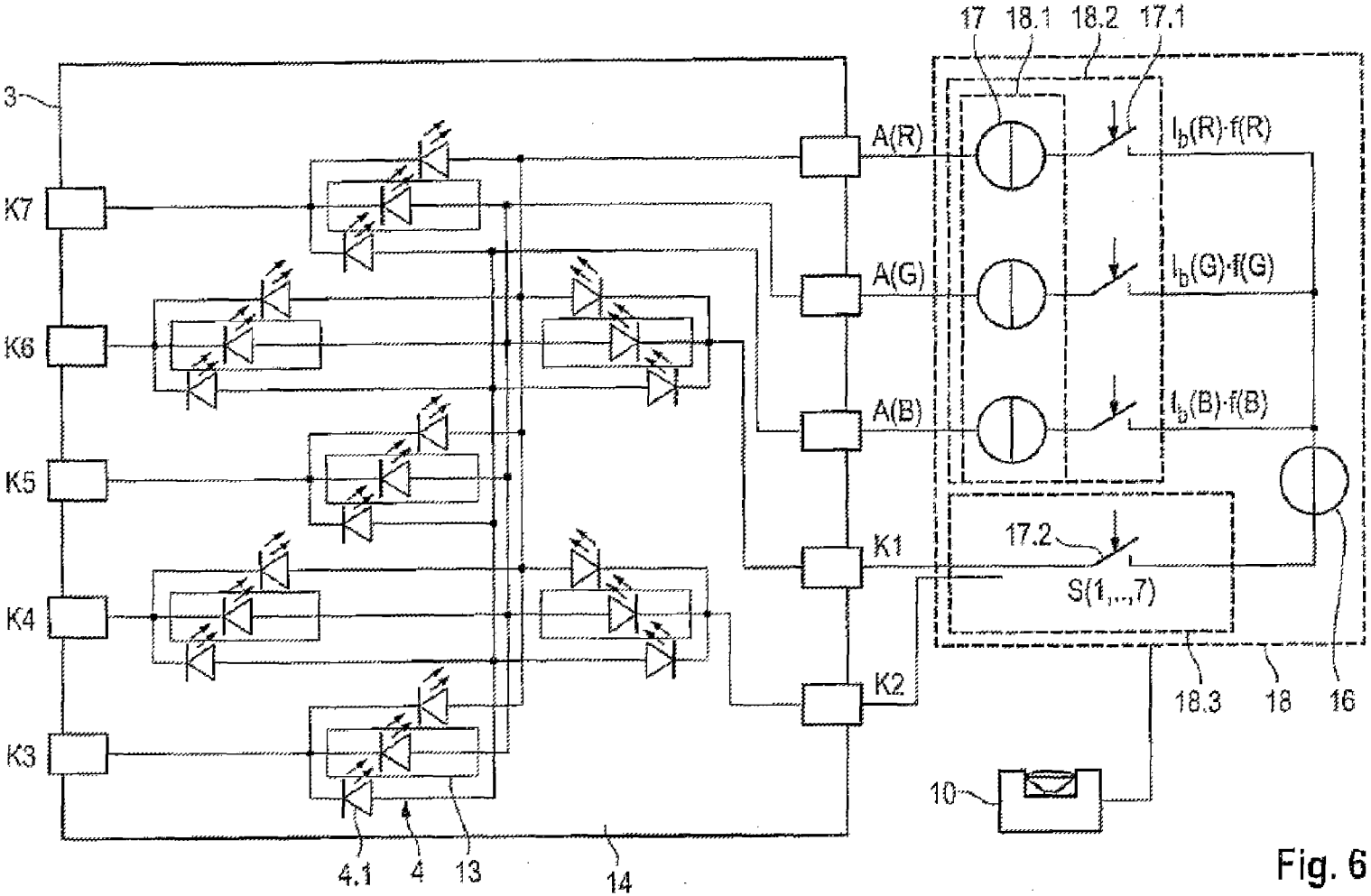
FIG. 6 shows an RGB configuration variant of the 7-segment display.

FIG. 6 shows a modification of the 7-segment display 14 illustrated in FIG. 5. In this case, the display 14 has seven RGB-LEDs, which are preferably of the same structure, in the form of light segments 13. These RGB-LEDs in each case correspond to those according to FIG. 4. Each RGB light segment 13 is also individually connected to a cathode $K_{1-7}$. In this case, the cathodes of the individual RGB-LEDs are connected together. The single-color base-color lamps 4.1 are each commonly connected to an anode A (R), A (G) and A (B). On the anode side, a switchable or controllable current drive 17 and a switch 17.1 of a control unit 18 are provided, which are incorporated in a current circuit with a voltage source 16. In a control block 18.1, by means of switchable current drive 17, the desired color coordinates on the anode side will be set up and fixed by means of the switchable current drive 17 by preselected base current intensities $I_b$(R,G,B), which correspond either to a desired perceived color or compensated color coordinates or provide a solid white balance for a color display application (not shown here). In a control block 18.2, the control can correct the fixed settings of color coordinates, for example, based on an error signal of the sensor 10, or regulate a desired brightness or set up other color coordinates for each individual luminous element, in particular in color displays or single-color displays with alternating color coordinates. Both the adjustments of the brightness (gray-scale value) as well as of the color coordinates can be made, for example, via a usual pulse width modulation (PWM) by means of switch 17.1 using an average attenuation factor f(R,G,B) or using a programmable current drive 17. The average current $I_b$(R,G,B)·f(R,G,B) controls the selectable basic brightness of the base color elements (4.1). During a complete switching cycle, a control block 18.3 controls the selected on/off switching states of the switches S(1, . . . , 7) 17.2 for the cathode connections $K_1$-$K_7$, in order to present the corresponding 7-segment symbol. The basic brightness can be reduced further, if necessary, by a sequential control of the luminous elements 4 via the control block 18.3.

This construction of an RGB 7-segment display leads to a minimum of 9 connections. Another construction would be with a single common anode A and 3 cathodes K(R), K(G), K(B) connections for each light segment 13. This leads to a total of 22 connections. The color coordinates and brightness can then be controlled individually for each light segment 13. Corresponding displays can also be presented with common cathodes. The control unit 18 can advantageously be coupled to a light sensor 10. Now, for example, as mentioned above, if a shift of the pre-adjusted color coordinates occurs caused by aging or as a consequence of temperature changes on the display face 1.1, then this will be detected by light sensor 10. In a control loop of control unit 18.2, the PWM is then adjusted so that a change occurs in the mixing ratio of the light emitted by the light segments 13 via a control of the average current ratio among the RGB base-color lamps 4.1. In this case, this control is produced electronically, for example, so that the color-point shift is compensated for by color mixing ratios stored in table form.

Of course, the previously described control scheme is not limited to a 7-segment display 14, but can also be used in any other display according to the invention.

For example, the desired display-side color coordinates of a single-color LCD-display can be adjusted in control block 18.1, for example, again particularly to provide a white display. Advantageously, a color error signal of a sensor 10 can be corrected by the control block 18.2. The color coordinates of a single-color display can also be changed here, so that additional information coupled to colors can be communicated.

In a completely corresponding way, the color coordinates of a color LCD display, whose base color production is based on color filters, can be adjusted with control block 18.1 to a desired white point on the display face and can be continuously corrected or modified via control block 18.2.

In addition, sequential color displays according to FIG. 6, which were mentioned initially, are provided in such a way that the color coordinates of the display that appear shifted after passage through the substrate 1 are adjusted to a desired white point on the display face by the control block 18.1 for all pixel-RGB luminous elements. Control block 18.2 takes over the color corrections based on error signals of a sensor 10 or the adjustment of alternative color coordinates (white points). In particular, the basic colors for activating the partial color images are switched sequentially via the control block 18.2 by means of switch 17.1. Optional line breaks can be provided via control block 18.2 by means of switch 17.1 or control block 18.3 by means of switch 17.2. The image content in the form of gray-scale values for each individual base color is generated via the LCD display.

In both embodiments of a color display, one further obtains the full perceived color of a color display, in particular white again appears as white, as through a color-neutral substrate 1.

Figure 7:
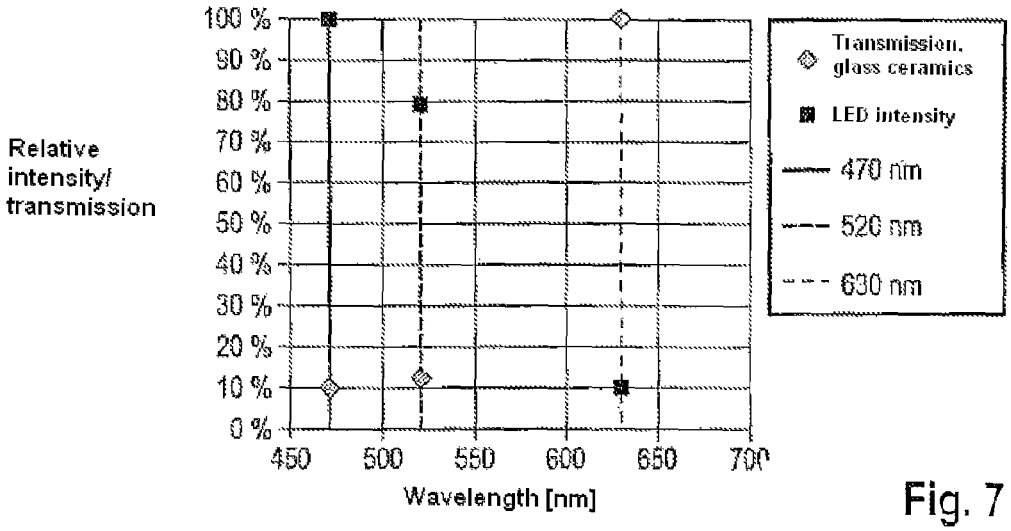
FIG. 7 shows a diagram, in which the relative intensity (transmission vs. the wavelength) of the light is presented in the spectral region.

Typical, relative transmission values for the glass ceramics of SCHOTT AG CERAN HIGHTRANS Eco® are illustrated by way of example in FIG. 7 for this material. There, the relative intensity of the light is plotted vs. the wavelength of the light for individual wavelengths in the region between 450 nm and 700 nm. In this case, one selects, as the reference value, the base colors of the RGB system, for which the substrate 1 has the highest transmission (smallest absorption) and sets the relative transmission value therefor at 100%. In the present case, the substrate 1 has the highest transmission for the color red (wavelength of 630 nm). With reference thereto, the relative transmission for green and blue amounts to 12.1% and 9.6%, respectively (520 nm and 470 nm). The RGB intensities of an ideal monochromatic RGB lamp must then amount to a relative 9.6% (red), 78.9% (green) and 100% (blue) in order to compensate for the spectrally non-homogeneous transmission of the substrate. The precisely required intensity ratios depend on the spectral width of the individual RGB lamps and must be calculated vs. the XYZ integrals of the CIExyY formalism.

Figure 8:
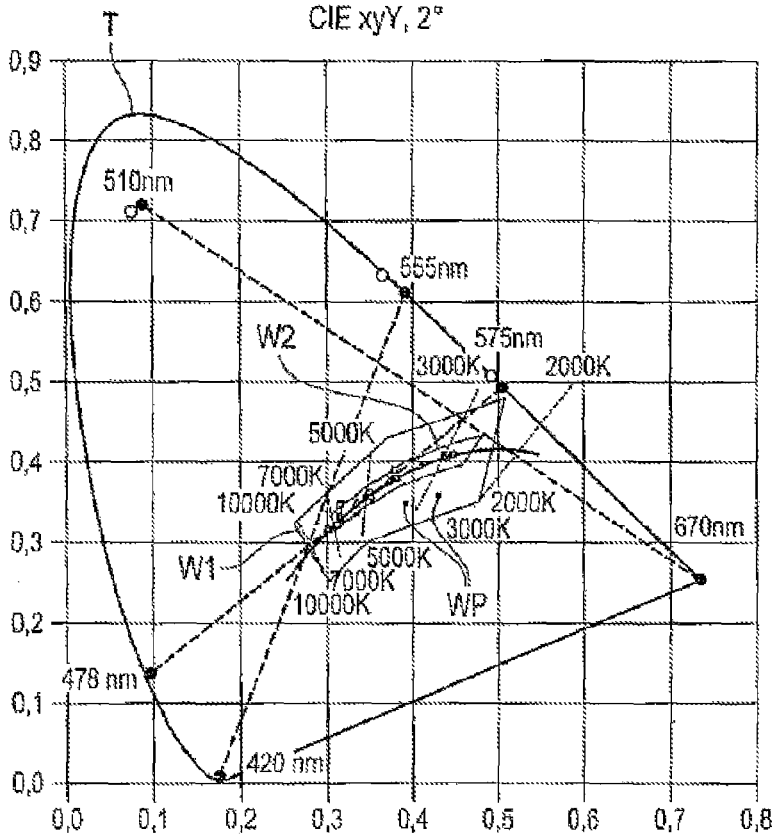
FIG. 8 shows a CIE/1931 diagram with colored LED pairs of a luminous element, by way of example.

With reference to FIG. 8, another advantageous, simplified luminous element is described. The luminous element here is configured so that it only comprises two base-color lamps, which are embodied, by way of example, as color LEDs. Two color LEDs span a color space, which can be represented by the line connecting their color coordinates in the CIExyY diagram, as is illustrated in FIG. 8. The color coordinates again lie inside or on the trichromacy curve T. Also, in the case of an arrangement with two luminous elements, with suitable selection of their emission wavelengths, white color coordinates, particularly even a standardized white point W, can be set up; in fact, by control of their intensity ratios, the white color coordinates can vary between warm and cold white. An arrangement with two luminous elements, when compared to an arrangement with three luminous elements (for example, RGB), insofar as this is of advantage, can be made as small as the structural size of the luminous elements themselves, for example in the design of a 7-segment display. The smallest possible display size of a 7-segment display is determined by the number of base-color lamps (for example, LEDs) in a segment. At the present time, minimum display heights of 13 mm can be realized for two-LED arrangements, and of 20 mm for three-LED displays. Preferably, an arrangement with two luminous elements shall be realized, which intersects or is tangential to the white region W1 or to the white region W2 (ANSI_NEMA_ANSLG C78.377-2008) in the) CIExyY (2°) diagram (see FIG. 8), and preferably intersects or is tangential to the Planck color curve (Planck locus). Preferably, two color LEDs are disposed in pairs as an arrangement with two luminous elements, which have peak wavelengths of $478^{+32}_{-58}$ nm and $575^{-20}_{+95}$ nm, preferably of $478^{+5}_{-10}$ nm and $575^{-5}_{+10}$ nm. In FIG. 8, by way of example, LED pairs are shown with their peak wavelengths labeled: The gray circle symbols localize the color coordinates of the LED light directly observed, and the black circle symbols localize the color coordinates of the LED light viewed through a CERAN HIGHTRANS® eco sample. Since color LEDs typically have a spectral half-maximum width of only 20-25 nm, only a small shift in the color coordinates occurs due to the spectrally non-homogeneous filter properties of the glass ceramics upon observation through the glass ceramics in comparison to the LED light observed directly. The dashes between the LED pairs represent the realizable color space (color coordinate line) of the LED pairs.

For example, thermochromic hot displays, which also make possible a display of the operating state in the hot region of the cooktop, can be realized with the displays according to the invention.

It is also conceivable that in this case, the RGB light of one or more luminous element(s) 4 is supplied by light-conducting fibers, in particular, glass fibers, and is coupled to substrate 1 at the desired site of rear face 1.2.

The invention is not limited to the described examples of embodiment. The displays according to the invention can also be used particularly for the backlighting of colored architectural glasses.

The invention claimed is:

1. A display comprising:

a substrate at least partially composed of a colored partially transparent material, the substrate having a spectrally non-homogeneous transmission curve, whereby the substrate has a display face and a rear face;

at least one luminous element disposed in a region of the rear face, the at least one luminous element having at least two base-color lamps; and a control unit controlling a base-color brightness of at least one of the at least two base-color lamps to correct a shift of color coordinates due to the non-homogeneous transmission curve of the substrate, wherein the substrate has a relative transmission difference $d_T$>50% in the wavelength region between 470 nm and 630 nm and an average transmission that is greater than 0.2% for each of the spectral regions of 420-500 nm, 500-620 nm and 550-640 nm.

2. The display according to claim 1, wherein the substrate has a relative transmission difference $d_T$>80% in the wavelength region between 470 nm and 630 nm.

3. The display according to claim 1, wherein the substrate has a relative transmission difference 95%>$d_T$>80% in the wavelength region between 470 nm and 630 nm.

4. The display according to claim 1, wherein the substrate has a relative transmission in a region between 9% and 15% at a wavelength of 520 nm and between 7% and 13% at a wavelength of 470 nm, relative to transmission at a wavelength of 630 nm.

5. The display according to claim 1, wherein the average transmission is greater than 0.4% for each of the spectral regions of 420-500 nm, 500-620 nm and 550-640 nm.

6. The display according to claim 1, comprising a maximum transmission of less than 40% in the spectral region of 400 to 750 nm and less than 4% in the spectral region of 450 to 600 nm.

7. The display according to claim 6, wherein the maximum transmission is less than 25% in the spectral region of 400 to 750 nm.

8. The display according to claim 1, wherein the at least one luminous element comprises three base-color lamps, one of the three base-color lamps emits light between wavelengths of 580 nm and 750 nm, a second of the three base-color lamps emits light between 480 nm and 590 nm, and a third of the three base-color lamps emits light between 400 nm and 505 nm.

9. The display according to claim 1, wherein the at least one luminous element comprises three base-color lamps, which emit light at dominant wavelengths of 470 nm, 520 nm and 630 nm with an aberration of the dominant wavelength of ±5 nm.

10. The display according to claim 1, wherein the at least one luminous element comprises two base-color lamps having a line connecting color coordinates of the two base-color lamps that intersects or is tangential to a white region $W_1$ in the CIExyY diagram (2° observer).

11. The display according to claim 10, wherein one of the two base-color lamps has a peak wavelength in a region between 420 nm and 510 nm.

12. The display according to claim 1, wherein the at least one luminous element has an optical diffuser element.

13. The display according to claim 1, further comprising one or more elements disposed in a location selected from the group consisting of a display region produced by the at least one luminous element, a region of the display face, a region of the rear face, and combinations thereof.

14. The display according to claim 1, further comprising a light sensor that receives a part of light emitted on the display face.

15. The display according to claim 1, wherein the at least one luminous element emits light having an adjustable spectral composition.

16. The display according to claim 1, wherein the at least one luminous element has base-color luminous elements sufficient to produce a color polygon on the display face, the color polygon containing a white region W1 at least partially and a white region W2 at least partially.

17. The display according to claim 16, wherein the white region W1 and the white region W2 comprise:

| | X | y | | x | y |
|---|---|---|---|---|---|
| W1 | 0.3 | 0.25 | W2 | 0.3068 | 0.3113 |
| | 0.26 | 0.33 | | 0.3028 | 0.3304 |
| | 0.37 | 0.43 | | 0.3205 | 0.3481 |
| | 0.51 | 0.48 | | 0.3207 | 0.3462 |
| | 0.48 | 0.35 | | 0.3376 | 0.3616 |
| | 0.35 | 0.3 | | 0.3551 | 0.376 |
| | 0.3 | 0.25 | | 0.3548 | 0.3736 |
| | | | | 0.3736 | 0.3874 |
| | | | | 0.4006 | 0.4044 |

-continued

| X | y | x | y |
|---|---|---|---|
| | | 0.3996 | 0.4015 |
| | | 0.4299 | 0.4165 |
| | | 0.4562 | 0.426 |
| | | 0.4813 | 0.4319 |
| | | 0.4593 | 0.3944 |
| | | 0.4147 | 0.3814 |
| | | 0.3889 | 0.369 |
| | | 0.3898 | 0.3716 |
| | | 0.367 | 0.3578 |
| | | 0.3512 | 0.3465 |
| | | 0.3515 | 0.3487 |
| | | 0.3366 | 0.3369 |
| | | 0.3222 | 0.3243 |
| | | 0.3221 | 0.3261 |
| | | 0.3068 | 0.3113. |

18. The display according to claim 1, wherein the at least one luminous element has white, blue or UV luminous elements in combination with narrow-band color filters or in combination with color luminescent materials as base-color lamps.

19. The display according to claim 1, wherein the at least one luminous element is sealed off, at least in regions, by a light-tight enclosing housing.

20. The display according to claim 1, wherein the at least one luminous element forms pixels of a color display.

21. The display according to claim 1, wherein the at least one luminous element forms a backlighting of a one-color display.

22. The display according to claim 1, wherein the at least one luminous element forms a backlighting of a colored display.

23. The display according to claim 1, wherein the at least two base-color lamps are sequentially controlled LEDs.

24. A display comprising:

a colored glass-ceramic substrate with a non-homogeneous transmission curve and an average transmission that is greater than 0.2% for spectral regions of 420-500 nm, 500-620 nm and 550-640 nm, the glass-ceramic substrate has a display face and a rear face;

one or more decorative elements on the display face, at least some of the one or more decorative elements forming markings of a cooking zone;

a light diffuser;

a luminous element at the rear face so as to illuminate at least some of the one or more decorative elements through the glass-ceramic substrate, the luminous element having a red light-emitting LED, a green light-emitting LED, and a blue light-emitting LED that emit a light cone through the diffuser; and a control unit controlling the luminous element to correct a shift of color coordinates due to the non-homogeneous transmission curve of the substrate, the diffuser being configured to intermix light in the light cone uniformly and homogeneously so that, after the diffuser, a homogeneous perceived color is formed on the display face.

25. The display according to claim 24, further comprising a light-tight housing enclosing the luminous element, the diffuser, and an entire light path from the luminous element to the rear face of the substrate.

26. The display according to claim 24, wherein at least a portion of the one or more decorative elements forms a reflecting element, the reflecting element being configured to reflect the light of the homogeneous perceived color on the display face back through the glass-ceramic substrate to the rear face.

27. The display according to claim 26, further comprising a light sensor positioned at the rear face to detect a condition of light reflected by the reflecting element.

28. The display according to claim 27, wherein the control unit is in communication with the light sensor, the control unit being configured to control the luminous element based on the condition of the light from the light sensor.

29. A display method, comprising:

selecting a colored glass-ceramic substrate with a non-homogeneous transmission curve and an average transmission that is greater than 0.2% for spectral regions of 420-500 nm, 500-620 nm and 550-640 nm;

disposing a decorative element on a display face of the glass-ceramic substrate;

disposing a plurality of luminous elements at the rear face; and controlling the plurality of luminous elements to illuminate the decorative element through the glass-ceramic substrate, wherein the step of controlling further comprises controlling the plurality of luminous elements to correct a shift of color coordinates due to the non-homogeneous transmission curve of the glass-ceramic substrate.

30. The display method of claim 29, further comprising:

disposing a diffuser between the rear face of the glass-ceramic substrate and the plurality of luminous elements so as to intermix light emitted by the plurality of luminous elements uniformly and homogeneously so that, after the diffuser, a homogeneous perceived color is formed on the display face.

* * * * *